US007673974B2

(12) United States Patent
Takahashi et al.

(10) Patent No.: US 7,673,974 B2
(45) Date of Patent: Mar. 9, 2010

(54) DROPLET DISCHARGING HEAD AND DROPLET DISCHARGING APPARATUS

(75) Inventors: Hayato Takahashi, Chino (JP); Shinri Sakai, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 402 days.

(21) Appl. No.: 11/687,982

(22) Filed: Mar. 19, 2007

(65) Prior Publication Data

US 2007/0216729 A1 Sep. 20, 2007

(30) Foreign Application Priority Data

Mar. 17, 2006 (JP) ..... 2006-074791

(51) Int. Cl.
*B41J 2/045* (2006.01)

(52) U.S. Cl. ..... 347/68

(58) Field of Classification Search ..... 347/68–72, 347/73–81

See application file for complete search history.

(56) References Cited

U.S. PATENT DOCUMENTS 7,413,293 B2 * 8/2008 Jeanmaire ..... 347/77

FOREIGN PATENT DOCUMENTS

| | | |
|---|---|---|
| JP | A 08-323993 | 12/1996 |
| JP | 2000-318178 | 11/2000 |
| JP | A 2000-318172 | 11/2000 |
| JP | A 2005-280189 | 10/2005 |

* cited by examiner

*Primary Examiner*—K. Feggins
(74) *Attorney, Agent, or Firm*—Oliff & Berridge, PLC

(57) ABSTRACT

A droplet discharging head includes a first drive unit and a base coupled to the first drive unit. The base includes a portion defining a first cavity, a portion defining a first discharging port, and a portion defining a first through hole through which the portion defining a first cavity and the portion defining a first discharging port communicate with each other. The droplet discharging head also includes a plurality of first electrode branches and a plurality of second electrode branches. The plurality of first electrode branches and the plurality of second electrode branches are disposed alternately apart from each other on a periphery of the portion defining a first discharging port, and extend on a surface of the portion defining a first through hole.

11 Claims, 8 Drawing Sheets

DROPLET DISCHARGING HEAD AND DROPLET DISCHARGING APPARATUS

TECHNICAL FIELD

Several aspects of the present invention relate to a droplet discharging head and a droplet discharging apparatus.

RELATED ART

In recent years, as droplet discharging apparatuses using inkjet technology, image forming apparatuses, such as ink jet printers, used to print images on paper, have been developed as well as film forming apparatuses used to form metal wires for a display panel.

For example, a droplet discharging head (ink jet head) for such an ink jet printer, which has a plurality of discharging ports (nozzle opening), causes ink ingredients to be deposited and attached on peripheries of the discharging ports. This may cause some discharging ports to become clogged, preventing normal discharging of droplets. Clogging in the discharging ports causes problems, such as occurrence of missing dots in a printed image.

According to a related art example to address those problems, JP-A-8-323993, it is possible to detect non-discharging of droplets by providing temperature sensors in the positions of the discharging ports of a droplet discharging head that make contact with droplets when the droplets are discharged and detecting whether or not the droplets have been discharged, based on variations in resistance caused by evaporation of the contacted droplets.

However, while the technology disclosed in the related art example described above is suited to determining whether or not it is completely impossible to discharge droplets through the discharging ports, it is not suited to determining whether or not foreign matters, such as ink ingredients, are attached on the peripheries of the discharging ports. In other words, the technology is not sufficient to prevent the flight deflection of droplets caused by the foreign matters attached.

An advantage of the invention is to provide a droplet discharging head and a droplet discharging apparatus that are each constructed so as to detect whether or not foreign matters are attached on the discharging ports or the like and that each improve the accuracy of discharging of droplets, for example, by preventing the flight deflection of the discharged droplets.

A droplet discharging head according to a first aspect of the invention includes a first drive unit and a base coupled to the first drive unit. The base includes a portion defining a first cavity, a portion defining a first discharging port, and a portion defining a first through hole through which the portion defining a first cavity and the portion defining a first discharging port communicate with each other. The droplet discharging head also includes a plurality of first electrode branches and a plurality of second electrode branches. The plurality of first electrode branches and the plurality of second electrode branches are disposed alternately apart from each other on a periphery of the portion defining a first discharging port, and extend on a surface of the portion defining a first through hole.

When these features are used, it is possible to check whether or not foreign matters are attached on the periphery of the portion defining a first discharging port or on the surface of the portion defining a first through hole by measuring a resistance between the first electrode branches and second electrode branches. As a result, it is possible to improve the accuracy of discharging of droplets from the droplet discharging head. Providing the plurality of first electrode branches and the plurality of second electrode branches as well as forming those electrode branches closely on the periphery of the portion defining a first discharging port or on the surface of the portion defining a first through hole allows the accuracy of detection of attached foreign matters to be improved.

A droplet discharging head according to a second aspect of the invention includes a first drive unit, a second drive unit, and a base coupled to the first and second drive units. The base includes a portion defining a first cavity controlled by the first drive unit, a portion defining a first discharging port, a portion defining a first through hole through which the portion defining a first cavity and the portion defining a first discharging port communicate with each other, a portion defining a second cavity controlled by the second drive unit, a portion defining a second discharging port, and a portion defining a second through hole through which the portion defining a second cavity and the portion defining a second discharging port communicate with each other. The droplet discharging head also includes a first electrode formed on a periphery of the portion defining a first discharging port, a second electrode formed on a periphery of the portion defining a first discharging port, a third electrode formed on a periphery of the portion defining a second discharging port, and a fourth electrode formed on a periphery of the portion defining a second discharging port. The first to fourth electrodes are formed apart from each other.

When these features are used, it is possible to check whether or not foreign matters are attached on the periphery of the portion defining a first discharging port or the like by measuring a resistance between the first and second electrodes. As a result, it is possible to improve the accuracy of discharging of droplets from the droplet discharging head. Additionally it is possible to measure a resistance at a plurality of portions defining a discharging port separately. This makes it possible to halt discharging of droplets from a portion defining a discharging port where attachment of a foreign matter has been confirmed, allowing the maintenance frequency of the head to be reduced.

A droplet discharging head according to a third aspect of the invention includes a first drive unit and a base coupled to the first drive unit. The base includes a portion defining a first cavity, a portion defining a first discharging port, and a portion defining a first through hole through which the portion defining a first cavity and the portion defining a first discharging port communicate with each other. The droplet discharging head also includes a first electrode and a second electrode. The first and second electrodes are formed apart from each other on a periphery of the portion defining a first discharging port.

When these features are used, it is possible to check whether or not foreign matters are attached on the periphery of the portion defining a first discharging port or the like by measuring a resistance between the first and second electrodes. As a result, it is possible to improve the accuracy of discharging of droplets from the droplet discharging head.

In the droplet discharging head according to the second aspect of the invention, the first and second electrodes preferably extend on a surface of the portion defining a first through hole.

According to these features, it is possible to detect a foreign matter attached on the periphery of the portion defining a first discharging port as well as on the surface of the portion defining a first through hole.

In the droplet discharging head according to the second aspect of the invention, it is preferable that the first electrode include a plurality of first electrode branches, the second electrode include a plurality of second electrode branches, and the plurality of first electrode branches and the plurality of second electrode branches be disposed alternately on a surface of the portion defining a first through hole.

For example, as the interval between two second electrode branches with one first electrode branch therebetween is made shorter, the accuracy of detection of attached foreign matters becomes higher. Therefore, closely forming the plurality of first electrode branches and the plurality of second electrode branches on the surface of the portion defining a first through hole allows the accuracy of detection of attached foreign matters to be improved.

In the droplet discharging head according to the second aspect of the invention, the periphery of the portion defining a first discharging port is preferably formed of an insulating material.

According to these features, it is possible to easily detect a resistance between the first and second electrodes at the portion defining a first discharging port.

In the droplet discharging head according to the first aspect of the invention, the surface of the portion defining a first through hole is preferably formed of an insulating material.

According to these features, it is possible to easily detect a resistance between the first and second electrodes at the portion defining a first through hole.

In the droplet discharging head according to the second aspect of the invention, it is preferable that the first drive unit include a piezoelectric element, and the portion defining a first cavity be a first pressure chamber whose volume varies according to an operation of the first drive unit.

According to these features, it is possible to use a piezoelectric element in the droplet discharging head. The piezoelectric element does not operate by heating, so drying of droplets is not promoted unlike when heating is used. This reduces the frequency with which foreign matters are attached on the periphery of the portion defining a first discharging port or the like. As a result, it is possible to improve the accuracy of discharging of droplets.

In the droplet discharging head according to the second aspect of the invention, it is preferable that the base include a flow channel substrate and a nozzle plate, the portion defining a first cavity be formed in the flow channel substrate, and the portion defining a first discharging port and the portion defining a first through hole be formed in the nozzle plate.

According to these features, it is possible to use a droplet discharging head whose base is formed of separate members, that is, the flow channel and nozzle plate, thereby enhancing flexibility in design.

A droplet discharging apparatus according to a fifth aspect of the invention includes the droplet discharging head according to claim 2 and a control unit for controlling the first drive unit. The control unit has a function of measuring a resistance between the first and second electrodes to detect a measured resistance.

According to these features, it is possible to detect a foreign matter attached on the periphery of the portion defining a first discharging port or the like. For example, when a conductive function material is discharged, an attached foreign matter is easily detected, improving the accuracy of maintenance of the droplet discharging apparatus. As a result, film forming quality is improved.

A droplet discharging apparatus according to a sixth aspect of the invention includes the droplet discharging head according to claim 2 and a control unit for controlling the first drive unit. The control unit has a function of measuring a resistance between the first and second electrodes to detect a measured resistance, as well as has a function of halting an operation of the first drive unit if the measured resistance is a resistance setting or less.

According to these features, when a foreign matter is attached on the periphery of the portion defining a first discharging port or the like, it is possible to halt discharging of droplets from the portion defining a first discharging port. For example, when a conductive function material is discharged, an attached foreign matter is easily detected, improving the accuracy of maintenance of the droplet discharging apparatus. As a result, film forming quality is improved.

BRIEF DESCRIPTION OF THE DRAWINGS

The invention will be described with reference to the accompanying drawings, where like numbers reference like elements.

DESCRIPTION OF EXEMPLARY EMBODIMENTS

Embodiments of a droplet discharging head and a droplet discharging apparatus (film forming apparatus) according to the invention will now be described. First, a droplet discharging apparatus according to the invention, that is, a droplet discharging apparatus including a droplet discharging head according to the invention will be described before explaining the droplet discharging head according to the invention.

Droplet Discharging Apparatus

Figure 1:
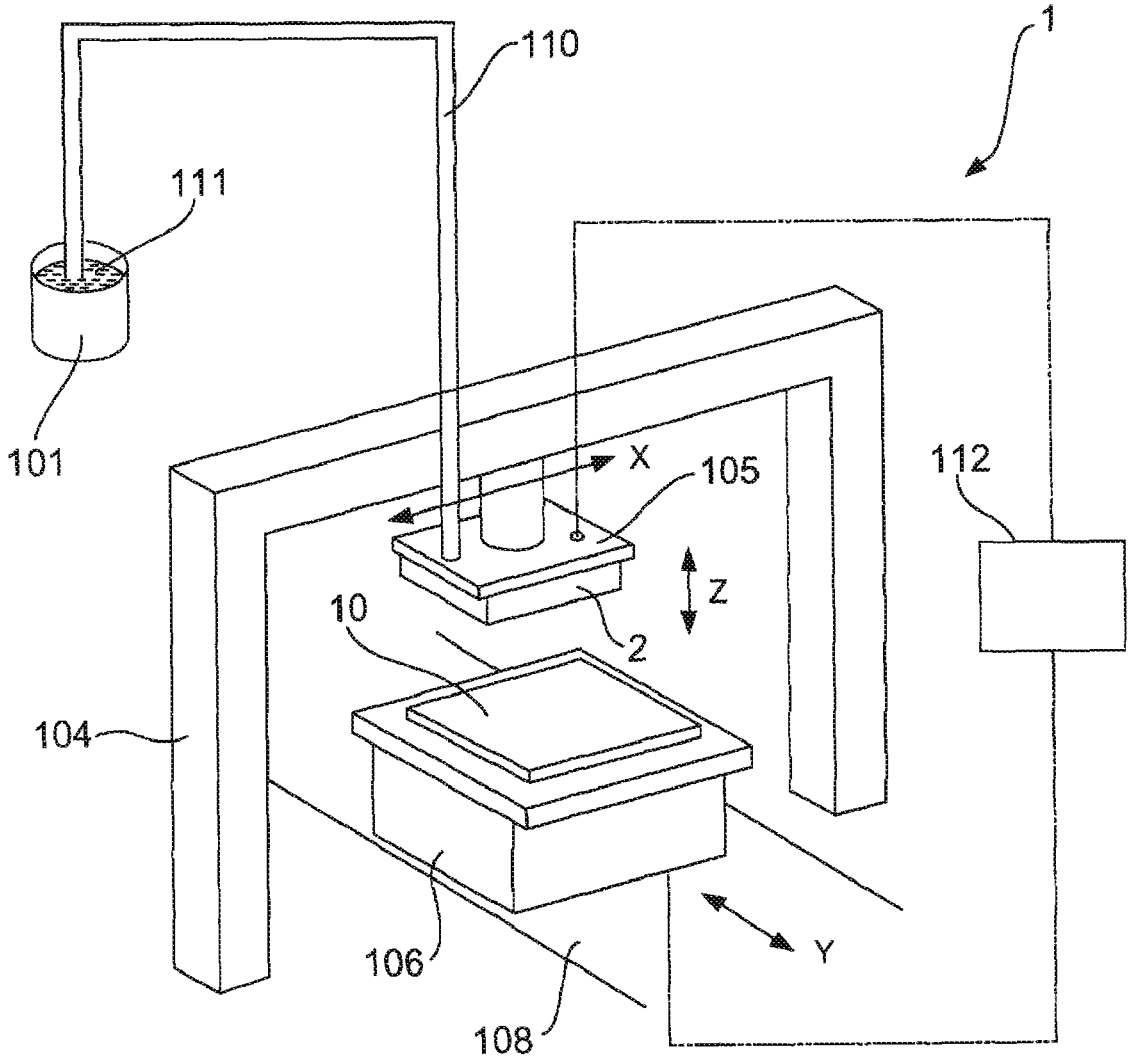
FIG. 1 is a drawing schematically showing construction of a droplet discharging apparatus.

FIG. 1 is a drawing schematically showing construction of a droplet discharging apparatus according to one embodiment. As shown in FIG. 1, a droplet discharging apparatus 1 includes a carriage 105 that includes a plurality of droplet discharging heads 2 for discharging droplets, a carriage moving mechanism (moving means) 104 that moves the carriage 105 in one horizontal direction (hereinafter referred to as "X axis direction"), a stage 106 that holds a substrate 10 to which droplets are given, a stage moving mechanism (moving means) 108 that moves the stage 106 in a horizontal direction (hereinafter referred to as "Y axis direction") perpendicular to the X axis direction, and a control unit 112. Provided near the droplet discharging apparatus 1 is a tank 101 in which a liquid material 111 is stored. The tank 101 and carriage 105 are coupled to each other via a tube 110 that is a duct through which the liquid material 111 is sent. The liquid material 111 that is stored in the tank 101 is sent (supplied) to the droplet discharging head 2, for example, by the force of compressed air.

The liquid material 111 is not limited to any specific material as long as it has a viscosity in which the material can be discharged from the droplet discharging head 2. Various types of liquid material, solution, and dissolving solution can be used for the liquid material 111. A solid material may be dispersed in the liquid material 111 as long as the liquid material 111 is a fluid as a whole. In other words, the liquid material 111 is made by dissolving or dispersing a material for a color element film in a solvent, so may be a solution or dispersion liquid (suspension or emulsion).

The operation of the carriage moving mechanism 104 is controlled by the control unit 112. The carriage moving mechanism 104 according to this embodiment also serves to move the carriage 105 along the Z axis direction (vertical direction) to adjust the height of the carriage 105. Additionally the carriage moving mechanism 104 serves to rotate the carriage 105 about an axis in parallel to the Z axis, allowing the angle of the carriage 105 with respect to the Z axis to be fine-tuned.

The stage 106 has a plane in parallel to both the X and Y axis directions. The stage 106 is constructed so that the substrate 10 to which droplets are to be given can be fixed or held on a plane of the stage 106.

The stage moving mechanism 108 moves the stage 106 along the Y axis direction perpendicular to both the X and Z axis directions. The operation of the stage moving mechanism 108 is controlled by the control unit 112. The stage moving mechanism 108 according to this embodiment also serves to rotate the stage 106 about an axis parallel to the Z axis. This makes it possible to fine-tune the inclination with respect to the Z axis of the substrate 10 placed on the stage 106 so that the substrate 10 is straight.

As described above, the carriage 105 is moved in the X axis direction by the carriage moving mechanism 104, while the stage 106 is moved in the Y axis direction by the stage moving mechanism 108. In other words, the relative position of the carriage 105 to the stage 106 is changed by the carriage moving mechanism 104 and stage moving mechanism 108.

Figure 2:
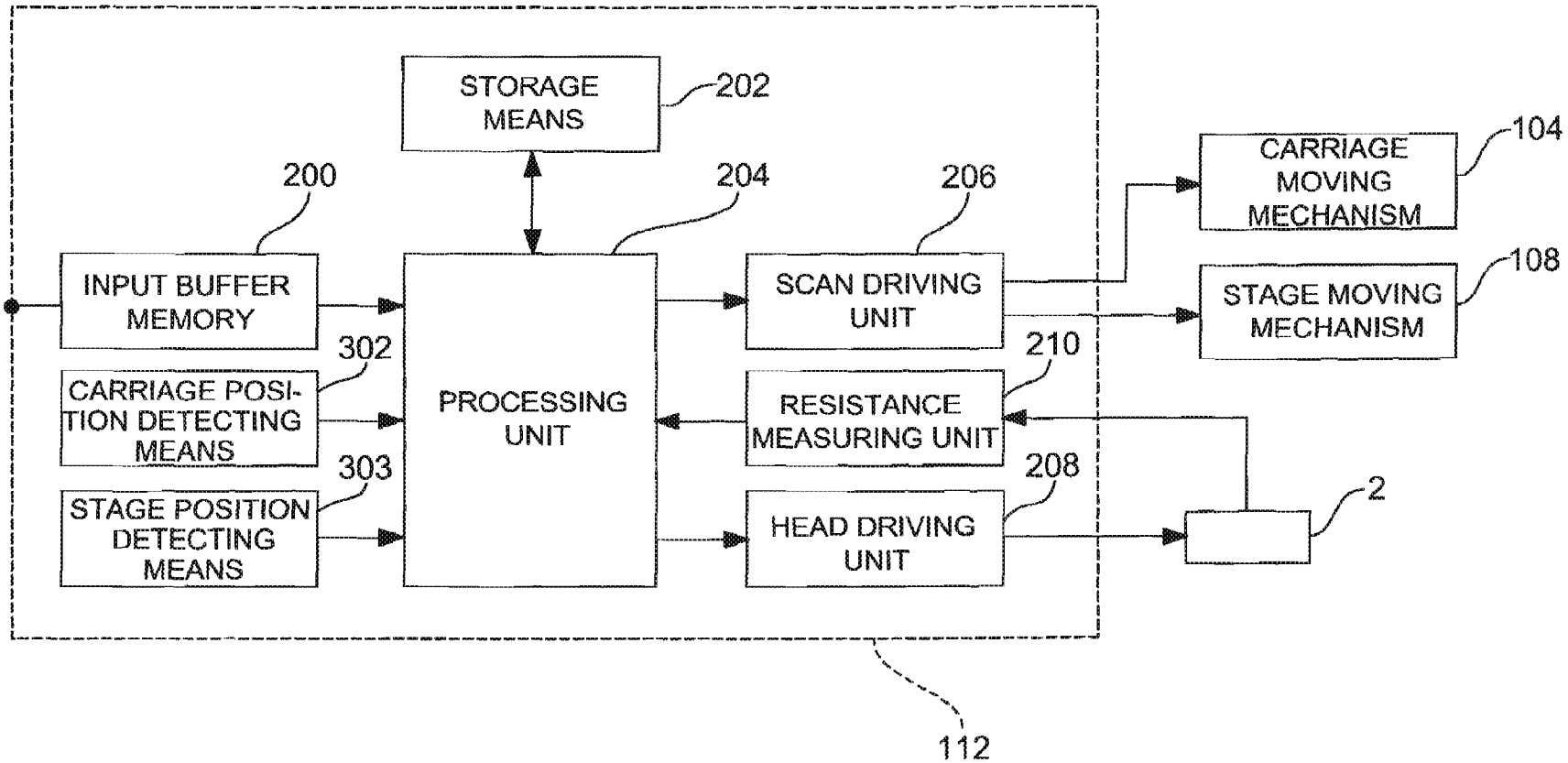
FIG. 2 is a block diagram showing composition of a control system of the droplet discharging apparatus.

FIG. 2 is a block diagram showing composition of a control system for the droplet discharging apparatus shown in FIG. 1. As shown in FIG. 2, the control unit 112 includes an input buffer memory 200, a storage means 202, a processing unit 204, a scan driving unit 206, a head driving unit 208, a resistance measuring unit 210, a carriage position detecting means 302, and a stage position detecting means 303.

The input buffer memory 200 and processing unit 204 are coupled so as to communicate with each other. The processing unit 204 and storage means 202 are coupled so as to communicate with each other. The processing unit 204 and the scan driving unit 206 are coupled so as to communicate with each other. The processing unit 204 and head driving unit 208 are coupled so as to communicate with each other. The scan driving unit 206 is coupled to the carriage moving mechanism 104 and stage moving mechanism 108 so as to communicate with those mechanisms, respectively. The head driving unit 208 is coupled to the droplet discharging head 2 so as to communicate with each other. The resistance measuring unit 210 is coupled to the processing unit 204 and droplet discharging head 2.

The input buffer memory 200 receives data concerning positions onto which droplets of the liquid material 111 are discharged, that is, drawing pattern data from an external information processor (not shown). The input buffer memory 200 provides this drawing pattern data to the processing unit 204, and the processing unit 204 stores the drawing pattern data in the storage means 202. The storage means 202 includes a RAM, a magnetic recording medium, an optical magnetic memory medium, or the like. The resistance measuring unit 210 measures the resistance between a pair of electrodes provided near the discharging port of the droplet discharging head 2. This will be detailed later.

The carriage position detecting means 302 detects the position (travel distance) in the X axis direction of the carriage 105, that is, the droplet discharging head 2, and inputs a detection signal representing the detected position to the processing unit 204. The stage position detecting means 303 detects the position (travel distance) in the Y axis direction of the stage 106, that is, the base 10, and inputs a detection signal representing the detected position to the processing unit 204. The carriage position detecting means 302 and stage position detecting means 303 each include, for example, a linear encoder, a laser length measuring machine, or the like.

Based on the detection signals from the carriage position detecting means 302 and stage position detecting means 303, the processing unit 204 controls the operation of the carriage moving mechanism 104 and stage moving mechanism 108, respectively, via the scan driving unit 206 (closed loop control), thereby controlling the positions of the carriage 105 and substrate 10, respectively. Further the processing unit 204 controls the operation of the stage moving mechanism 108 to control the travel speed of the stage 106, that is, the substrate 10. Furthermore the processing unit 204 gives selection signals for specifying on/off of the nozzles at each discharging timing to the head driving unit 208 based on drawing pattern data. The head driving unit 208 gives discharging signals necessary to discharge the liquid material 111 to the droplet discharging head 2 based on the selection signals. Consequently the liquid material 111 is discharged as droplets from the droplet discharging head 2. The control unit 112 is, for example, a computer including a CPU, a ROM, and a RAM. In this case, the aforementioned functions of the control unit 112 are achieved by a software program executed by the computer. As a matter of course, the control unit 112 may be a dedicated circuit (hardware).

Now the droplet discharging head 2 will be described in detail as an example of a droplet discharging head according to the invention.

Figure 3:
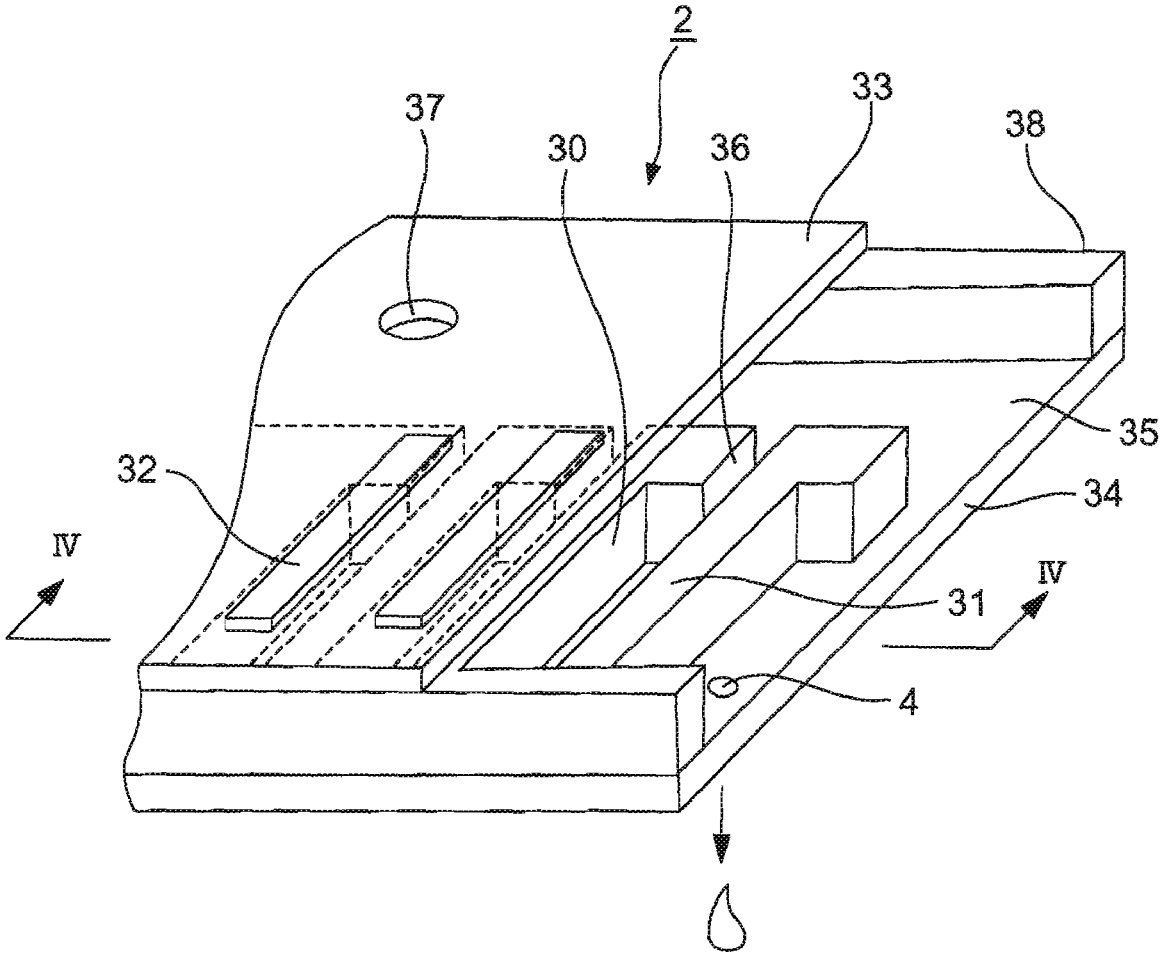
FIG. 3 is an oblique perspective view partially showing a detailed structure of a part of a droplet discharging head through which a liquid material is discharged.
Figure 4:
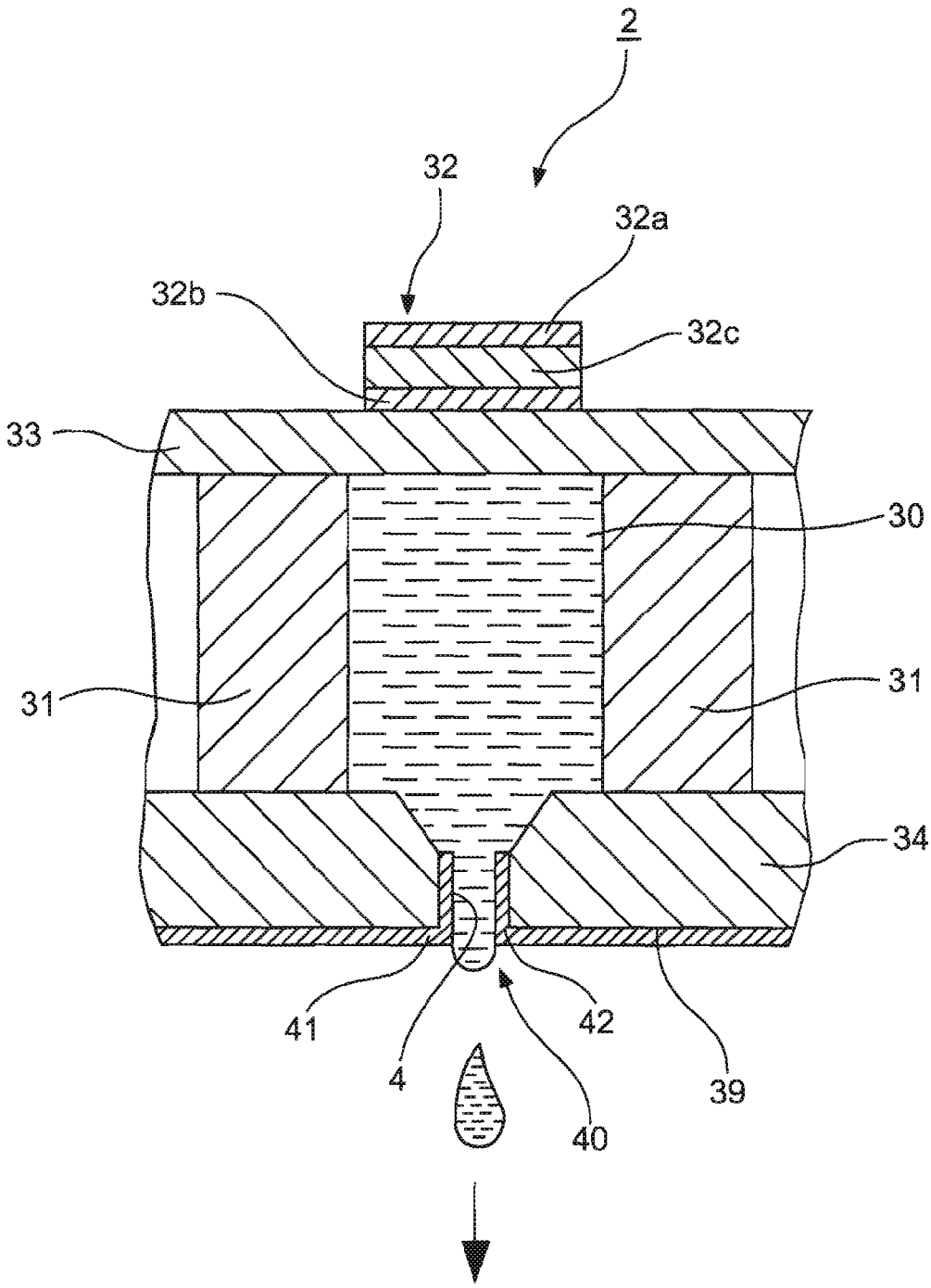
FIG. 4 is a sectional view partially showing the detailed structure of the part of the droplet discharging head through which the liquid material is discharged.

FIG. 3 is an oblique perspective view partially showing a detailed structure of a part of a droplet discharging head through which a liquid material is discharged. FIG. 4 is a sectional view partially showing the detailed structure of the part of the droplet discharging head through which the liquid material is discharged.

As shown in FIG. 3, the droplet discharging head 2 includes a diaphragm 33 and a nozzle plate 34, and a flow channel substrate 38. The diaphragm 33 and nozzle plate 34 are integrated with the flow channel substrate 38 therebetween. The flow channel substrate 38 includes a reservoir 35, a plurality of partition walls 31, and a plurality of cavities 30. The cavities 30 are provided corresponding to the through holes 4, so the number of the cavities 30 is the same as that of the through holes 4. The cavities 30 each receive a liquid material from the reservoir 35 via a supply channel 36 located between a pair of the partition walls 31. In this example, the flow channel substrate 38 and nozzle plate 34 correspond to a "base" according the claims of to the invention.

As shown in FIG. 4, the diaphragm 33 has thereon a piezoelectric element 32 (drive unit) corresponding to each cavity 30. The piezoelectric element 32 includes a piezoelectric material layer 32*c* and electrodes 32*a* and 32*b* between which the piezoelectric material layer 32*c* is interposed. Applying a drive voltage to these electrodes 32*a* and 32*b* causes a liquid material to be discharged in the form of droplets via the corresponding through hole 4. If the piezoelectric element 32 is constructed so as to expand and contract in the thickness direction of the diaphragm 33, the positions of the electrodes and the material for the piezoelectric material layer can arbitrarily be set. The through hole 4 here is a portion through which the cavity 30 and the discharging port 40 provided on the droplet discharging surface 39 communicate with each other. The surface of the through hole 4 is a surface of a part of the nozzle plate 34 in FIG. 4, and means a surface located between the cavity 30 and the discharging port 40. The discharging port 40 is a boundary between the through hole 4 and droplet discharging surface 39. The periphery of the discharging port 40 means a region of the droplet discharging surface 39 that makes contact with the liquid material when the liquid material is discharged. The periphery of the discharging port 40 is formed of an insulating material. The surface of the through hole 4 is also formed of an insulating material. The cavity 30 in this example is a pressure chamber whose volume varies according to an operation of the piezoelectric element 32. The electrodes 41 and 42 extend on the surface of the through hole 4 and are formed from the surface of the through hole 4 to the periphery of the discharging port 40.

Figure 5:
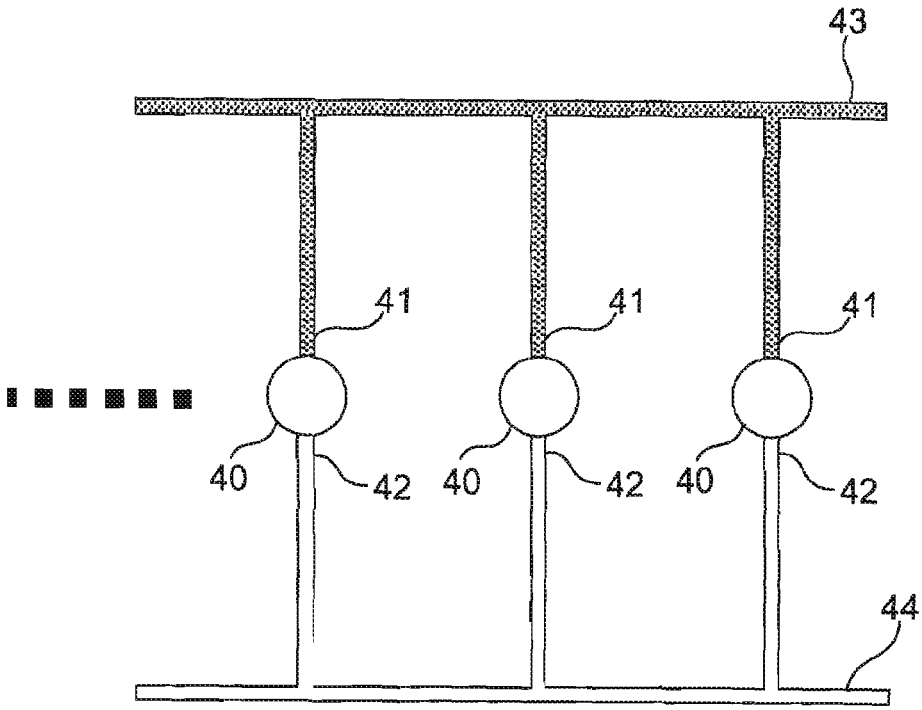
FIG. 5 is a schematic plan view showing disposition of electrodes.

FIG. 5 is a schematic plan view showing disposition of the electrodes. FIG. 5 is a plan view showing the periphery of the discharging port 40. A pair of electrodes 41 and 42 are formed apart from each other on the periphery of each discharging port 40. Each electrode 41 is coupled to a common line 43. Similarly each electrode 42 is coupled to a common line 44. In terms of correspondence with the claims of the invention, for example, the most left discharging port 40 corresponds to "a first discharging port," and the electrodes 41 and 42 provided on the periphery of this discharging port 40 correspond to "a first electrode" and "a second electrode 42," respectively. The second (center) discharging port 40 from the left in the figure corresponds to "a second discharging port," and the electrodes 41 and 42 provided on the periphery of this discharging port 40 correspond to "a third electrode" and "a fourth electrode," respectively. These electrodes 41 and 42, which form pairs, are used to detect whether or not a deposit of the liquid material is attached on the periphery of the discharging port 40 and thus the discharging port is clogged. Specifically, a determination whether or nor there is clogging is made by measuring a resistance caused between a pair of electrodes 41 and 42 in a manner such as to apply a voltage to the electrodes 41 and 42 and then to measure the flowing current. If there is no deposit, the measured resistance will be a very high value because the electrodes 41 and 42 are apart from each other. On the other hand, if a deposit occurs, the electrodes 41 and 42 are electrically coupled to each other via the deposit, thereby obtaining a resistance depending on the property, quantity, and the like of the deposit. The electrodes 41 and 42 are coupled to the resistance measuring unit 210 in the control unit 112 (see FIG. 2). The resistance measuring unit 210 measures the resistance between the electrodes 41 and 42 to detect a measured resistance. The measured resistance is inputted to the processing unit 204. The processing unit 204, for example, performs control so that if the measured resistance is a predetermined resistance setting or less, the operation of the piezoelectric element 32 of the droplet discharging head 2 is halted. A capacitance may be used instead of a resistance.

Figure 6:
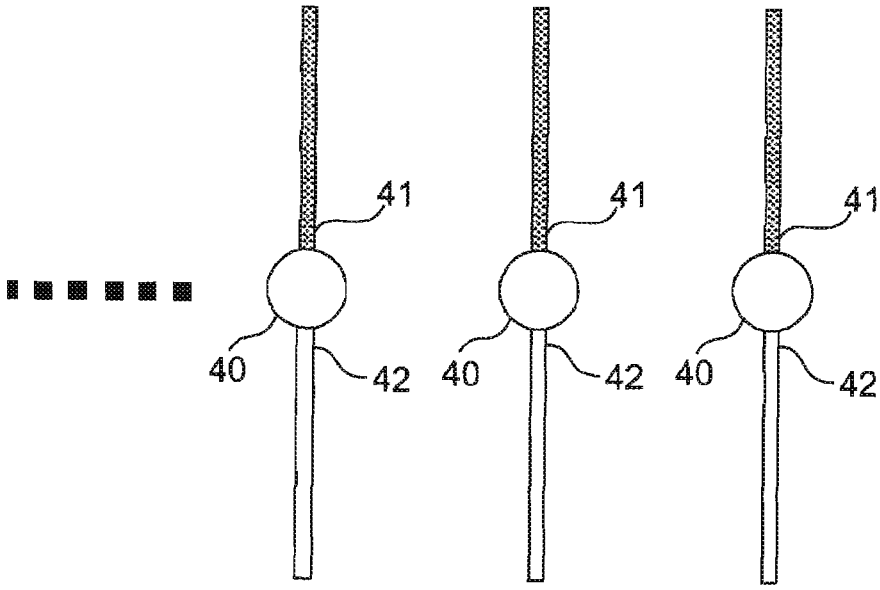
FIG. 6 is a schematic plan view showing another form of the electrodes.

FIG. 6 is a schematic plan view showing another form of the electrodes. As seen in an example shown in FIG. 6, it is possible to omit the common lines 43 and 44 to make each electrode 41 and each electrode 42 exist independently from other electrodes 41 and other electrodes 42, respectively. These features make it possible to easily determine whether or not there is clogging for each discharging port 40. Alternatively it is possible to make only either one of the electrodes (e.g., electrode 41) become independent while coupling the other electrode (e.g., electrode 42) to a common line. Coupling the common line to a reference potential (e.g., ground potential) allows a determination whether or not there is clogging to be made for each discharging port 40.

Figure 7:
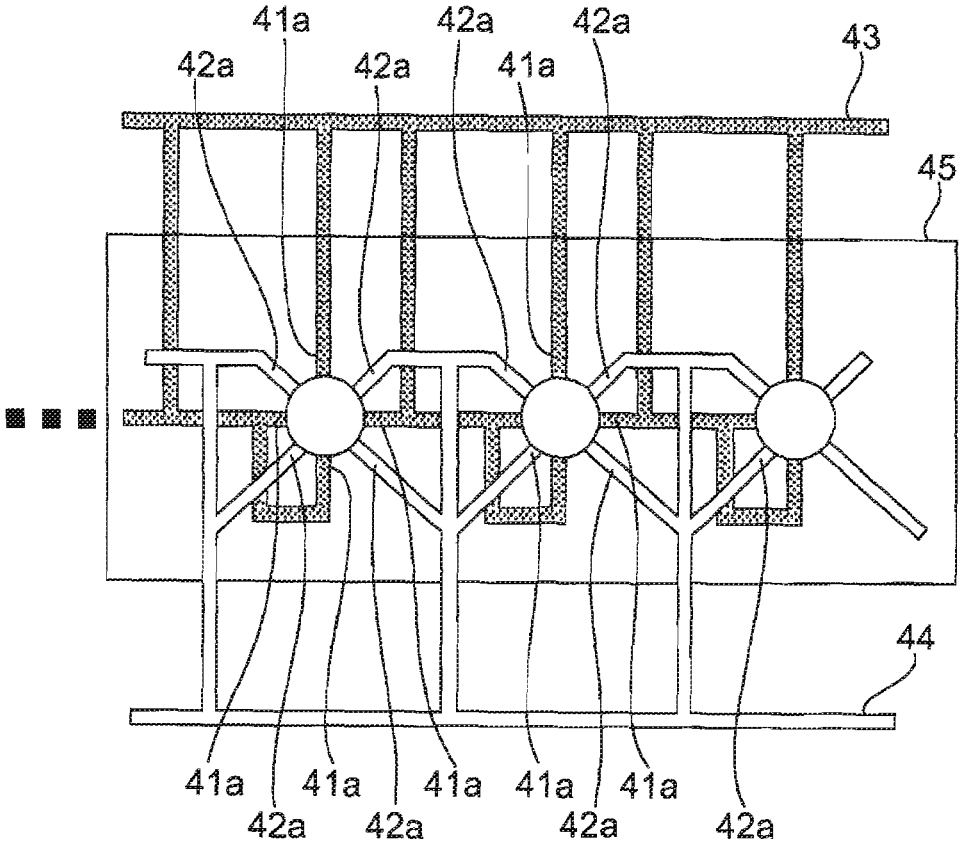
FIG. 7 is a schematic plan view showing still another form of the electrodes.

FIG. 7 is a schematic plan view showing still another form of the electrodes. In an example shown in FIG. 7, a plurality of electrode branches 41*a* and a plurality of electrode branches 42*a* are provided on the periphery of the discharging port 40. More specifically, each electrode branch 41*a* and each electrode branch 42*a* are disposed apart from each other alternately on the periphery of the discharging port 40. In this example, the electrode branches 41*a* function as one electrode as a whole, and similarly the electrode branches 42*a* function as one electrode as a whole. Although not shown, both the electrode branches 41*a* and the electrode branches 42*a* extend on the surface of the through hole 4, as with the electrodes 41 and 42 described above (see FIG. 4). Each electrode branch 41*a* is coupled to the common line 43, while each electrode branch 42*a* is coupled to the common line 44. The electrode branches 41*a* and electrode branches 42*a* are vertically stacked and disposed with an insulating film 45 therebetween. The insulation film 45 ensures insulation between both the electrode branches. In terms of correspondence with the claims of the invention, the electrode branches 41*a* correspond to "a plurality of first electrode branches," while the electrode branches 42*a* correspond to "a plurality of second electrode branches."

Figure 8:
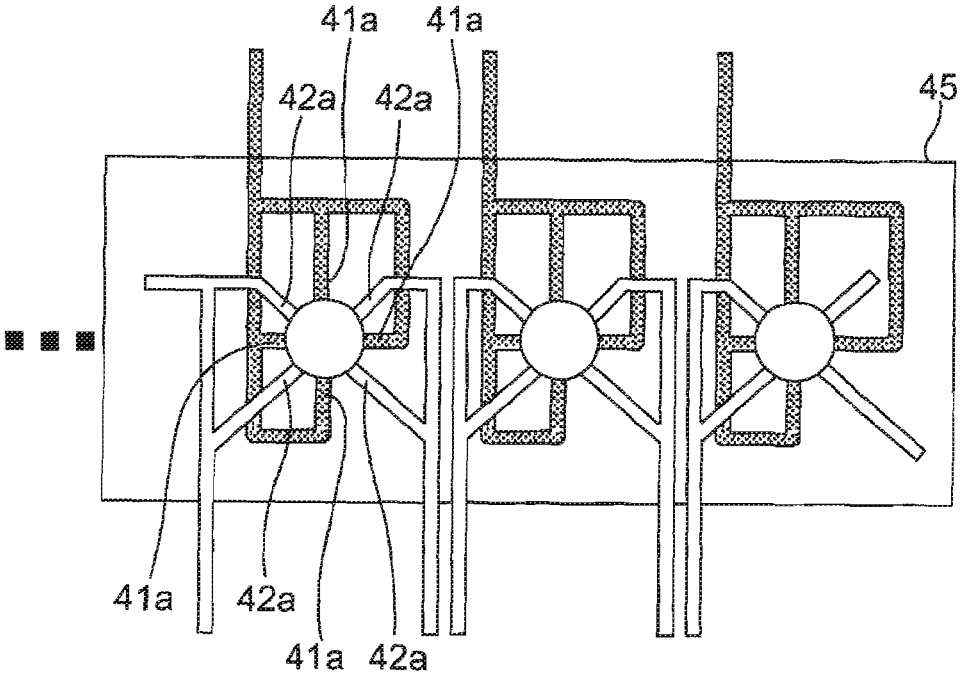
FIG. 8 is a schematic plan view showing yet another form of the electrodes.

FIG. 8 is a schematic plan view showing yet another form of the electrodes. As seen in an example shown in FIG. 8, it is possible to omit the common line 43 so as to make each electrode branch 41*a* independent from other electrode branches 41*a* for each discharging port 40 as well as to omit the common line 44 so as to make each electrode branch 42*a* independent from other electrode branches 42*a* for each discharging port 40. These features allow a determination whether or not there is clogging to be easily made for each discharging port 40. Alternatively it is possible to make only either of groups of electrode branches 41*a* and groups of electrode branches 42*a* independent from each other while coupling the other groups of electrode branches to a common line. Coupling the common line to a reference potential (e.g., ground potential) allows a determination whether or not there is clogging to be made for each discharging port 40.

While an embodiment in which the invention is applied to a type of droplet discharging head whose base includes a flow channel substrate and a nozzle plate has heretofore been described, the invention can also be applied to a type of droplet discharging head whose base is formed in one piece so as to include a cavity, an discharging port, and a through hole, as described below.

Figure 9:
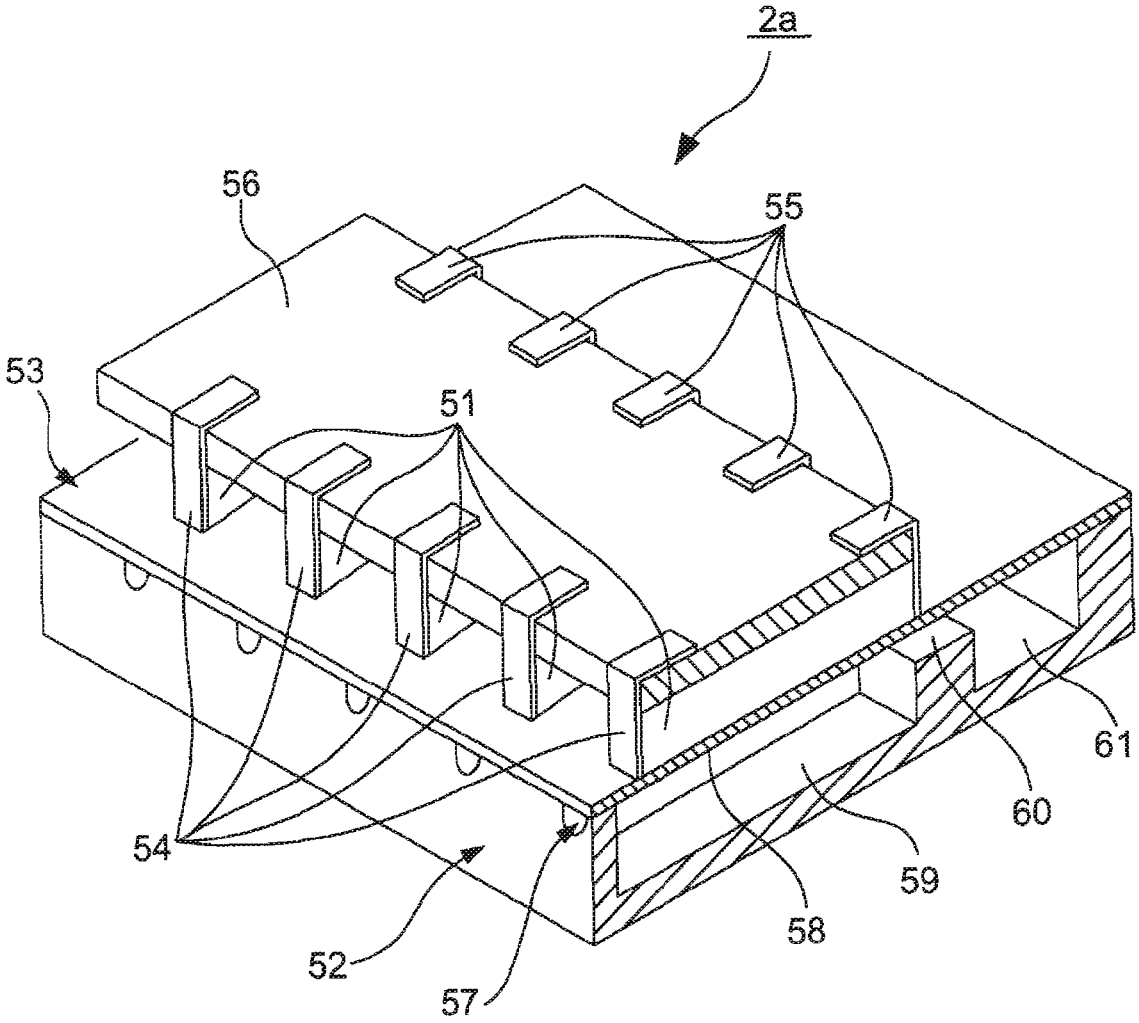
FIG. 9 is an oblique perspective view schematically showing a droplet discharging head according to another embodiment.
Figure 10:
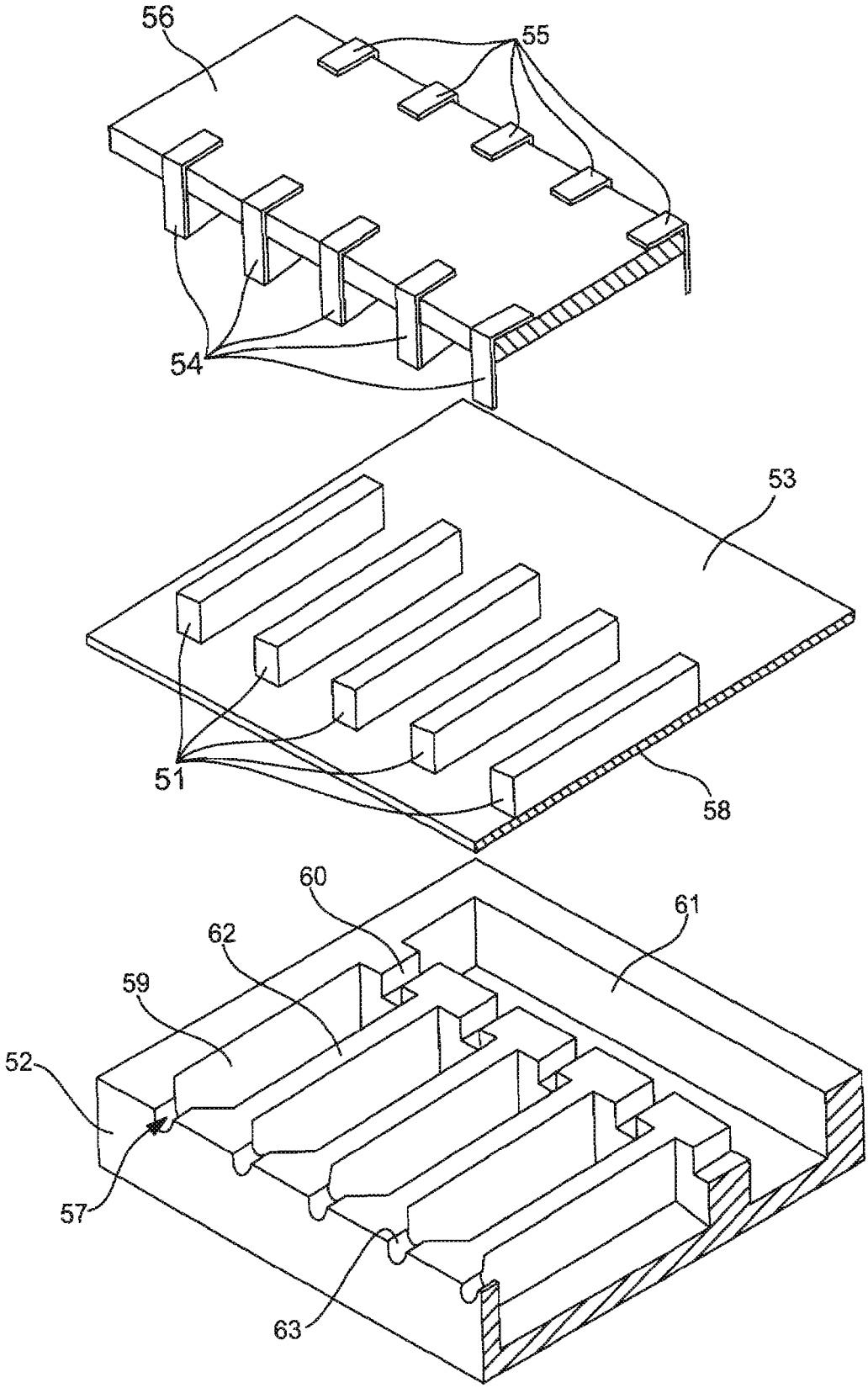
FIG. 10 is an exploded oblique perspective view of the droplet discharging head shown in FIG. 9.

FIG. 9 is an oblique perspective view schematically showing a droplet discharging head according to another embodiment. FIG. 10 is an exploded oblique perspective view of the droplet discharging head shown in FIG. 9.

A droplet discharging head 2*a* shown in FIG. 9 includes a substrate (base) 32 and a substrate (diaphragm) 53 that are joined together. A flow channel for a liquid material (liquid material 111 described above) is formed between these substrates 52 and 53. A piezoelectric element 51 is mounted on a side of the substrate 53 remote from the flow channel. The piezoelectric element 51 includes a plurality of piezoelectric elements 51. These piezoelectric elements 51 are joined (fixed) to the substrate 56.

More specifically, as shown in FIG. 10, channels and hollows are formed on a side of the substrate 52 adjacent to the substrate 53. These channels and hollows define a plurality of cavities 59 for containing the liquid material, a plurality of discharging ports 57 through which the liquid material from the cavities 59 is discharged, one reservoir 61 for containing the liquid material to be supplied to the cavities 59, and a plurality of supply channels 60 through which the liquid material is supplied from the reservoir 61 to the cavities 59.

The plurality of cavities 59 are provided in parallel with each cavity 59 between partition walls 62. Each cavity 59 is defined by members including the partition wall 62 and the diaphragm 58, and communicates with the discharging port 57 via the through hole 63 and contains the liquid material. Each cavity 59 communicates with the reservoir 61 via the supply channel 60. This allows the liquid material to be supplied from the reservoir 61 to each cavity 59 via the corresponding supply channel 60. The reservoir 61 receives the liquid material from the abovementioned tube 110 via a supply unit (not shown).

A part of the substrate 53 that constitutes a wall surface of each cavity 59 having such features functions as a diaphragm 58. Therefore, displacing (vibrating) each diaphragm 58 causes the volume of the corresponding cavity 59 to vary, allowing droplets to be discharged from the corresponding discharging port 57 via the corresponding through hole 63. As in the abovementioned embodiment, a pair of electrodes or electrode branches (see FIGS. 5 to 8) can be provided so as to extend on the periphery of each discharging port 57, or on the periphery of each discharging port 57 and on the surface of the corresponding through hole 63 through which the discharging port 57 and cavity 59 communicate with each other.

As shown in FIGS. 9 and 10, each piezoelectric element 51 is joined to a section corresponding to each cavity 59 on a side of each diaphragm 58 having such features remote from the corresponding cavity 59, that is, on a side of the substrate 53 remote from the substrate 52 along a longitudinal direction of the diaphragm 58. In other words, each piezoelectric element 51 is joined to an outer surface of the diaphragm 58 for each cavity 59.

Each piezoelectric element 51 is constructed so as to expand and contract in the thickness direction of the corresponding diaphragm 58. This causes each diaphragm 58 to be vibrated (displaced). Attached to each piezoelectric element 51 having such features are a first terminal 54 and a second terminal 55 both coupled to the head driving unit 208 described above. Thus, applying a voltage to each piezoelectric element 51 via the corresponding first and second terminals 54 and 55 causes the piezoelectric element 51 to be expanded and contracted, allowing the corresponding diaphragm 58 to be displaced (vibrated).

Joined and fixed to a side of each piezoelectric element 51 having such features remote from the substrate 53 is a substrate 56. In other words, the substrate 56 couples the adjacent piezoelectric elements 51 to each other on a side of the substrate 56 remote from the cavities 59. Coupling the adjacent piezoelectric elements 51 to each other on the side remote from the cavities 59 in this manner allows the driving force of each piezoelectric element 51 to be transmitted to the corresponding diaphragm 58 more reliably and efficiently. This makes it possible to increase variations in the volume of each cavity 59. As a result, power-saving and cost reduction of the droplet discharging head 2*a* can be achieved more certainly. The abovedescribed first and second terminals 54 and 55 can be accessed from the outside on the substrate 56.

According to the embodiments described above, it is possible to check whether or not foreign matters are attached on the periphery of the discharging ports or on the surface of the through holes. This makes it possible to improve the accuracy of discharging of droplets from the droplet discharging head.

The invention is not limited to the embodiments described above and modifications can be made to those embodiments as necessary within the scope and spirit of the invention. For example, while a piezoelectric element is described as an example of a drive unit in the abovedescribed embodiments, the drive unit is not limited to such a piezoelectric element and may be a mechanism that generates bubbles in a cavity, or the like.

The entire disclosure of Japanese Patent Application No: 2006-074791, filed Mar. 17, 2006 is expressly incorporated by reference herein.

What is claim is:

1. A droplet discharging head comprising:

a first drive unit;

a base coupled to the first drive unit, the base including a first portion defining a first cavity, a second portion defining a first discharging port, and a third portion defining a first through hole through which the first portion defining the first cavity and the second portion defining the first discharging port communicate with each other;

a plurality of first electrode branches; and a plurality of second electrode branches, the plurality of first electrode branches and the plurality of second electrode branches being disposed alternately apart from each other on a periphery of the second portion defining the first discharging port and extending on a surface of the third portion defining the first through hole.

2. The droplet discharging head according to claim 1, wherein the surface of the third portion defining the first through hole is formed of an insulating material.

3. A droplet discharging head comprising:

a first drive unit;

a second drive unit;

a base coupled to the first and second drive units, the base including a first portion defining a first cavity controlled by the first drive unit, a second portion defining a first discharging port, a third portion defining a first through hole through which the first portion defining the first cavity and the second portion defining the first discharging port communicate with each other, a fourth portion defining a second cavity controlled by the second drive unit, a fifth portion defining a second discharging port, and a sixth portion defining a second through hole through which the fourth portion defining the second cavity and the fifth portion defining the second discharging port communicate with each other;

a first electrode formed on a periphery of the second portion defining the first discharging port;

a second electrode formed on a periphery of the second portion defining the first discharging port;

a third electrode formed on a periphery of the fifth portion defining the second discharging port; and a fourth electrode formed on a periphery of the fifth portion defining the second discharging port, the first to fourth electrodes being formed apart from each other.

4. The droplet discharging head according to claim 3, the first and second electrodes extending on a surface of the third portion defining the first through portion.

5. The droplet discharging head according to claim 3, wherein the periphery of the second portion defining the first discharging port is formed of an insulating material.

6. The droplet discharging head according to claim 3, wherein:

the first drive unit includes a piezoelectric element; and the first portion defining the first cavity is a first pressure chamber whose volume varies according to an operation of the first drive unit.

7. The droplet discharging head according to claim 3, wherein:

the base includes a flow channel substrate and a nozzle plate;

the first portion defining the first cavity is formed in the flow channel substrate; and the second portion defining the first discharging port and the third portion defining the first through hole are formed in the nozzle plate.

8. A droplet discharging apparatus comprising:

the droplet discharging head according to claim 3; and a control unit for controlling the first drive unit, the control unit having a function of measuring a resistance between the first and second electrodes to detect a measured resistance.

9. A droplet discharging apparatus comprising:

the droplet discharging head according to claim 3; and a control unit for controlling the first drive unit, the control unit having a function of measuring a resistance between the first and second electrodes to detect a measured resistance and having a function of halting an operation of the first drive unit if the measured resistance is a resistance setting or less.

10. A droplet discharging head comprising:

a first drive unit;

a base coupled to the first drive unit, the base including a first portion defining a first cavity, a second portion defining a first discharging port, and a third portion defining a first through hole through which the first portion defining the first cavity and the second portion defining the first discharging port communicate with each other;

a first electrode; and a second electrode, the first and second electrodes being formed apart from each other on a periphery of the second portion defining the first discharging port.

11. The droplet discharging head according to claim 2, wherein:

the first electrode includes a plurality of first electrode branches;

the second electrode includes a plurality of second electrode branches; and the plurality of first electrode branches and the plurality of second electrode branches are disposed alternately on a surface of the third portion defining the first through hole.

* * * * *